US006068583A

United States Patent [19]

Sigl

[11] Patent Number: 6,068,583

[45] Date of Patent: May 30, 2000

[54] CONSUMER-ACTIVATED CLIP LIFT FEATURE FOR TISSUE CARTONS

[75] Inventor: Wayne Clement Sigl, Neenah, Wis.

[73] Assignee: Kimberly-Clark Worldwide, Inc., Neenah, Wis.

[21] Appl. No.: 09/292,506

[22] Filed: Apr. 15, 1999

[51] Int. Cl.[7] ..... B31B 1/25

[52] U.S. Cl. ..... 493/60; 206/494; 206/804; 221/56; 493/62

[58] Field of Search ..... 206/233, 494, 206/784, 804, 812; 221/36, 37, 38, 40, 45, 52, 56; 229/5.81; 493/67, 68, 86, 87, 60, 62

[56] References Cited

U.S. PATENT DOCUMENTS

| | | | |
|---|---|---|---|
| 1,206,124 | 11/1916 | Meyers | 206/804 |
| 1,463,619 | 7/1923 | Gardner | 206/804 |
| 1,586,248 | 5/1926 | Komura | 206/804 |
| 1,902,963 | 3/1933 | Lepage et al. | 206/804 |
| 2,011,403 | 8/1935 | Gessler . | |
| 2,047,090 | 7/1936 | Woolfson | 206/804 |
| 2,239,222 | 4/1941 | Funke | 206/804 |
| 2,287,420 | 6/1942 | Edmonston . | |
| 2,346,407 | 4/1944 | Wright | 206/804 |
| 2,447,279 | 8/1948 | Rosenfeld | 206/804 |
| 2,501,357 | 3/1950 | Speckman et al. . | |
| 2,634,855 | 4/1953 | Mandel . | |
| 2,636,599 | 4/1953 | Willis et al. | 221/57 |
| 2,701,053 | 2/1955 | Tamarin | 206/804 |
| 2,713,454 | 7/1955 | Nute et al. . | |
| 2,802,567 | 8/1957 | Covel . | |
| 2,803,376 | 8/1957 | Kampff | 206/804 |
| 2,816,699 | 12/1957 | Nute et al. . | |
| 2,849,152 | 8/1958 | Tuttle | 221/48 |
| 2,854,184 | 9/1958 | Heine . | |
| 2,858,045 | 10/1958 | Loeb | 221/59 |
| 3,202,316 | 8/1965 | Silver | 221/59 |
| 3,224,633 | 12/1965 | Allen | 221/48 |
| 3,258,156 | 6/1966 | Smith | 206/494 |
| 3,425,595 | 2/1969 | Shapira | 221/52 |
| 3,459,329 | 8/1969 | Mochizuki et al. | 221/34 |
| 3,603,452 | 9/1971 | Singer . | |
| 3,606,082 | 9/1971 | Kuchenbecker | 221/52 |
| 3,647,114 | 3/1972 | Bleuer | 221/59 |
| 3,837,562 | 9/1974 | Cali | 206/494 |
| 3,942,682 | 3/1976 | McKay | 221/58 |
| 3,982,685 | 9/1976 | Shimada | 206/494 |
| 4,231,491 | 11/1980 | Pierson et al. | 221/48 |
| 4,460,088 | 7/1984 | Rugenstein et al. | 206/494 |
| 4,586,631 | 5/1986 | Loder | 221/58 |
| 4,616,767 | 10/1986 | Seido | 221/58 |
| 4,723,658 | 2/1988 | Steel . | |
| 4,749,086 | 6/1988 | Donohie . | |
| 4,789,067 | 12/1988 | Silano . | |
| 4,816,094 | 3/1989 | Pomplun et al. | 156/85 |
| 4,871,345 | 10/1989 | Wosaba, II et al. | 493/67 |
| 4,938,821 | 7/1990 | Soderlund et al. | 156/85 |
| 4,985,300 | 1/1991 | Huang | 428/332 |
| 5,040,685 | 8/1991 | Focke et al. | 206/494 |
| 5,220,141 | 6/1993 | Quick et al. . | |
| 5,330,056 | 7/1994 | De La Rocha | 206/581 |
| 5,343,024 | 8/1994 | Prosise et al. | 219/730 |
| 5,362,504 | 11/1994 | Kamper et al. | 426/89 |
| 5,645,904 | 7/1997 | Woo et al. | 428/35.7 |
| 5,819,944 | 10/1998 | Terrasi | 206/804 |

OTHER PUBLICATIONS

Derwent World Patent Database abstract of EP 61,589: Description of W. Lohmann, "Dispenser For Folded Paper Towels".

*Primary Examiner*—Jim Foster
*Attorney, Agent, or Firm*—Gregory E. Croft

[57] ABSTRACT

A facial tissue carton, which enables the user to elevate the clip of tissues within the carton as the tissues are removed from the carton, comprises a strip of material, such as a paper strip, which is fixed at one end of the carton and extends underneath the tissue clip. A free end of the strip passes out through the opposite end of the carton. To elevate the partially used clip in order to avoid "fallback", the user simply pulls on the exposed end of the strip and appropriately secures the end of the strip at the end of the carton.

2 Claims, 6 Drawing Sheets

CONSUMER-ACTIVATED CLIP LIFT FEATURE FOR TISSUE CARTONS

BACKGROUND OF THE INVENTION

A popular feature of many tissue cartons is pop-up dispensing of single tissues. The tissues within the carton (often referred to as a "tissue clip") are interfolded such that as one tissue is dispensed through the opening in the top of the carton, the next interfolded tissue within the clip is partially dispensed. The carton opening is such that it constricts the tissue to hold it in this partially dispensed position for subsequent easy removal. While pop-up dispensing is very convenient, sometimes the next tissue does not make it through the dispensing opening, either because of a missed interfold within the clip or because of "fallback". Fallback occurs when the tissue stack within the carton is depleted to a point where the remaining tissues are too far below the dispensing opening to sufficiently adhere to the preceding tissue to be partially carried through the dispensing opening with the preceding tissue. The user must then reach into the carton and pull the tissues out individually, which is inconvenient.

Therefore there is a need for a means for preventing fallback of the tissues within the clip as the tissues within the carton are depleted.

SUMMARY OF THE INVENTION

It has now been discovered that fallback can be overcome by positioning a strip of paper or other suitable material inside of the carton below the tissue clip. One end of the strip of material is adhered to one end of the carton while the other end of the strip of material passes out of the carton and is exposed, or is at least easily accessible by the user. When the user pulls on the end of the strip of material, the partially depleted tissue clip is lifted toward the dispensing opening. This reduces the distance the tissues must travel to reach the opening, thus eliminating the chance for fallback to occur. The user then lodges the end of the strip in a slit provided in the end flap of the carton or otherwise immobilizes it to retain the strip (and the tissue clip) in position.

Hence in one aspect, the invention resides in a tissue carton containing a clip of tissues, said carton having a top wall through which tissues are dispensed, a bottom wall opposite the top wall, two side walls opposite each other and connecting the top and bottom walls, a first end wall and a second end wall opposite each other and connecting the top and bottom walls, and a strip of material fixedly attached to the first end wall and positioned within the carton between the clip of tissues and the bottom wall and slidably extending outwardly through the second end wall such that an end of the strip is exposed outside of the carton, whereby pulling on the exposed end of the strip causes the clip of tissues to move closer to the top wall.

In another aspect, the invention resides in a tissue carton containing a clip of tissues, said carton comprising: a top wall through which tissues are dispensed; a bottom wall opposite the top wall; two side walls opposite each other and connecting the top and bottom walls; a first end wall comprising a top flap and a bottom flap; a second end wall comprising a top flap and a bottom flap having a slit therein, said first and second end walls being opposite each other and connecting the top and bottom walls; and a strip of material having a first end and a second end and being positioned within the carton between the clip of tissues and the bottom wall, said first end of the strip of material being attached to the bottom flap of the first end wall and the second end of the strip of material slidably extending between the top and bottom flaps of the second end wall, such that pulling on the second end of the strip of material causes the clip of tissues to move closer to the top wall.

In another aspect, the invention resides in a carton blank comprising: a top panel, a bottom panel, a first side wall panel, a second side wall panel, a glue panel, a first top flap panel adjacent to a first end of the top panel, a second top flap panel adjacent to a second end of the top panel, a first bottom flap panel adjacent to a first end of the bottom panel, a second bottom flap panel adjacent to a second end of the bottom panel, a first side flap panel adjacent a first end of the first side wall panel, a second side flap panel adjacent a second end of the first side wall panel, a first side flap panel adjacent a first end of the second side wall panel, and a second side flap panel adjacent a second end of the second side wall panel, wherein a strip of material having a first end and a second end overlays the entire length of the bottom panel, the first end of the strip being adhered to the first bottom flap panel and the second end of the strip extending at least to the distal edge of the second bottom flap panel, and wherein the second bottom flap panel contains a slit adapted to receive the second end of the strip of material after the carton is assembled. More specifically, in one embodiment, the second end of the strip of material can extend beyond the distal edge of the second bottom flap panel. In such a case, the second end of the strip of material can be loose or lightly adhered (but easily detached by the user upon pulling on the second end of the strip of material) to the second bottom flap panel. In either case, it is preferred that the distal edge of the second bottom flap panel be notched, with the slit emanating from the bottom of the notch. In another embodiment, the second bottom flap panel can have a perforated notch with the slit emanating from the bottom of the perforated notch. In this case, the second end of the strip of material is substantially adhered or fixed to the perforated notch portion of the second bottom flap panel.

In another aspect, the invention resides in a method of making a carton blank comprising: (a) die cutting a sheet of carton board in the form of a carton blank having a top panel, a bottom panel, a first side wall panel, a second side wall panel, a glue panel, a first top flap panel adjacent to a first end of the top panel, a second top flap panel adjacent to a second end of the top panel, a first bottom flap panel adjacent to a first end of the bottom panel, a second bottom flap panel adjacent to a second end of the bottom panel, a first side flap panel adjacent a first end of the first side wall panel, a second side flap panel adjacent a second end of the first side wall panel, a first side flap panel adjacent a first end of the second side wall panel, and a second side flap panel adjacent a second end of the second side wall panel; (b) providing a slit in the second bottom flap panel that is generally perpendicular to the distal edge of the second bottom flap panel; (c) laying a first end of a strip of material over the bottom panel such that the strip of material extends from the first bottom flap panel to beyond the distal edge of the second bottom flap panel; (d) adhering the first end of the strip of material to the first bottom flap panel; and (e) cutting the strip of material at a point beyond the distal edge of the second bottom flap panel.

In another aspect, the invention resides in a method of making a carton blank comprising: (a) periodically cutting a strip of carton board to form a slit and perforations such that the perforations define an area within the carton board which will become a perforated tab; (b) adhering a strip of material to the carton board at points corresponding to the areas defined by the perforations and at points which correspond to areas which will become a first bottom flap; and (c) simultaneously cutting the adhered strip of material and consecutively die cutting adjacent carton blanks from the carton board which have a top panel, a bottom panel, a first side wall panel, a second side wall panel, a glue panel, a first top flap panel adjacent to a first end of the top panel, a second top flap panel adjacent to a second end of the top panel, a first bottom flap panel adjacent to a first end of the bottom panel, a second bottom flap panel adjacent to a second end of the bottom panel, a first side flap panel adjacent a first end of the first side wall panel, a second side flap panel adjacent a second end of the first side wall panel, a first side flap panel adjacent a first end of the second side wall panel, and a second side flap panel adjacent a second end of the second side wall panel.

The strip of material can be any material that has the integrity and strength to perform the function described herein. Particularly suitable materials include paper and nonwoven fabrics. Paper is particularly preferred because it is inexpensive, sufficiently strong, and easily processed during carton manufacture and/or carton filling. Because the strip of material must be capable of being trapped or immobilized after being pulled to raise the clip, it is preferable that the strip have a width sufficient to frictionally engage and trap the strip when pulled into a slit in the end flap of the carton. For this purpose, the strip should preferably be about ⅛ inch wide or greater, more specifically from about ¼ inch to about 1 inch wide, and still more specifically from about ½ inch to about ¾ inch wide.

As mentioned above, a suitable means for immobilizing the strip of material after it has been pulled to elevate the clip is a simple slit within the carton end wall, preferably emanating from the distal edge of the bottom end flap. The phrase "emanating from the distal edge" of the bottom end flap includes embodiments where there is a notch in the distal edge of the end flap and the slit emanates from the notch. The thickness of the slit will depend upon the thickness of the strip of material and the stiffness of the carton flap. The length of the slit can be any length sufficient to accommodate the strip of material and hold it in position. A suitable slit length is from about ⅛ inch to about 1 inch or greater. The shape of the slit can be straight or curved. A straight slit has been found to be sufficiently effective in retaining the strip of material and is simple. The angle of the slit relative to the distal edge of the can be any angle. Slits which are perpendicular or generally perpendicular to the distal edge of the bottom flap are simple and effective. However, more steeply angled slits can possibly provide greater holding or immobilizing capability if necessary.

Alternative means for immobilizing the strip of material include pressure-sensitive adhesives, coadhesives on the second end of the strip and on the end flap(s), or any other fixing means available to those skilled in the art.

While this invention is particularly applicable to facial tissues, it is also useful for other products in which a stack or clip of sheets are dispensed from a container or carton, such as boxed towels or wipes.

BRIEF DESCRIPTION OF THE DRAWINGS

FIG. 7 is an end view of the first end of the tissue carton, showing the shape of the first bottom flap. FIG. 8 is an end view of the second end of the tissue carton, showing a perforated tab in the second bottom flap to which the second end of the strip of material is adhered.

DETAILED DESCRIPTION OF THE DRAWINGS

Figure 1:
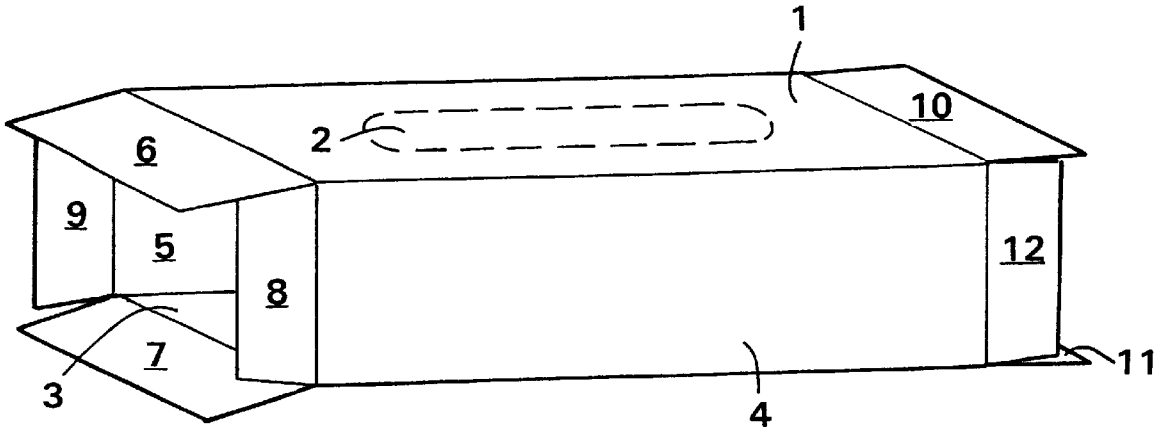
FIG. 1 is a perspective view of a typical facial tissue carton, showing the end flaps in an open position prior to being sealed.

Referring to the Drawings, the invention will be described in greater detail.

FIG. 1 depicts an empty facial tissue carton with the end flaps open. For purposes of reference, shown is top wall 1, a perforated opening 2 in the top wall through which tissues are dispensed, a bottom wall 3, a first side wall 4, and a second side wall 5. One end wall of the carton, referred to as the "first" end wall (shown in FIG. 3), has a top flap 6 and a bottom flap 7. It can also have, as shown, first and second side flaps 8 and 9. The opposite end wall, referred to as the "second" end wall, also has a top flap 10, a bottom flap 11 and first and second side flaps 12 and 13 (only side flap 12 is shown in this view).

Figure 2:
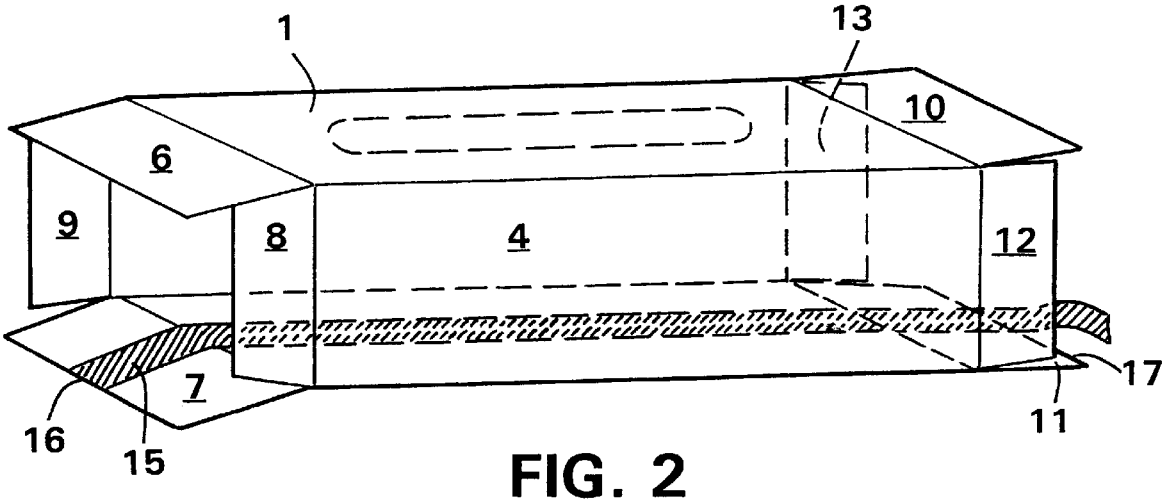
FIG. 2 is a perspective view of a tissue carton of this invention, showing the position of the strip of material prior to the end flaps of the carton being sealed.

FIG. 2 illustrates a carton similar to that of FIG. 1, but having a strip of material attached and positioned within the empty carton in accordance with this invention. As shown, the strip of material 15 is affixed at or near the edge 16 of the bottom flap 7 of the first end wall. The most convenient means for attaching the strip of material is glue or other adhesive. The preferred location on the bottom flap to which the strip is affixed will depend upon the desired maximum height to which the bottom of the tissue clip can be lifted within the carton. It will be appreciated that affixing the strip of material more towards the bottom wall 3 will reduce the extent to which the clip can be lifted. Also, the maximum height to which the clip can be raised is partially dependent upon the size of the top flap and the bottom flap. If the bottom flap is as large as the end wall and the top flap is very small, then the clip can be raised almost to the top of the carton. In addition, if the top flap 6 is folded inwardly before the bottom flap 7 when the first end wall is formed as the carton is sealed, the extent to which the bottom flap 7 overlaps the top flap 6 can also impact the maximum height to which the clip can be lifted. On the other hand, if the bottom flap is folded inwardly before the top flap, the degree of overlap will have no effect. However, the latter situation places greater stress on the adhesive at the point of attachment as the clip is lifted. For most situations, it is therefore preferred to fold in the top flap before folding in the bottom flap, thereby to some degree protecting the bond between the strip of material and the bottom flap.

Also as shown in FIG. 2, the strip of material 15 is positioned along the bottom of the carton, running through the carton such that the second end of the strip of material extends beyond the distal edge 17 of the bottom flap 11 of the second end wall of the carton. The strip of material is preferably not adhered to the bottom flap 11, although some temporary adhesion can be used to ensure stability while the carton is being filled with tissues and sealed, provided the adhesive bond is easily broken by the user when the strip of material is pulled out. After the strip of material is positioned, the carton is then loaded with a clip of facial tissue, preferably by sliding the clip into the carton from the open first end of the carton over bottom flap 7. The carton is then sealed shut with the side flaps being closed first, top end wall flaps second, and the bottom end wall flaps last, being careful that sealing adhesive used to glue the flaps closed at the second end does not bond the strip of material to any of the carton flaps. As such, the strip of material is not bonded and therefore slidably positioned between the top and bottom flaps of the second end wall. It is also positioned between the second side flaps 12 and 13.

Figure 3:
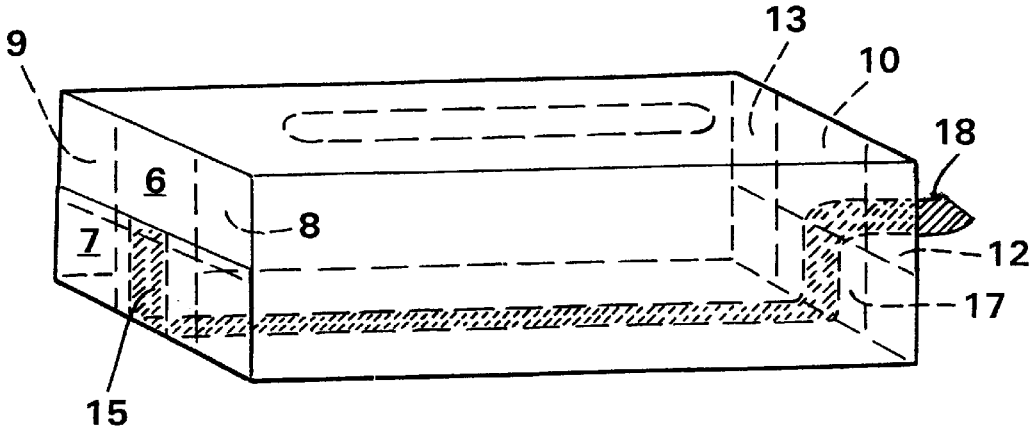
FIG. 3 is a perspective view of the carton of FIG. 2 after the end flaps have been sealed.

FIG. 3 illustrates the carton of FIG. 2 (but without a tissue clip) after the carton end flaps have been sealed. As shown, the second end 18 of the strip of material is exposed outside of the second end wall of the carton and is positioned to be grasped by the consumer to activate the clip lift feature. As can be envisioned from FIG. 3, as the second end 18 of the strip of material is pulled, the portion of the strip laying along the bottom of the carton will raise until it is pulled taught across the length of the carton. As used herein, the "end" of the strip of material is intended to be a general term referring to an end portion rather than the ultimate edge of the strip of material.

Figure 4:
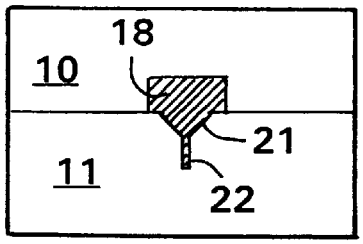
FIG. 4 is an end view of the carton of FIG. 3, viewed from the end through which the strip of material extends, showing a preferred means for immobilizing the end of the strip of material after it is pulled out to raise the clip.
Figure 5:
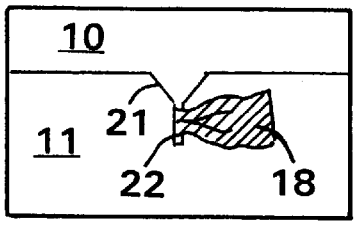
FIG. 5 is an end view similar to FIG. 4, but showing the end of the strip of material lodged within the slit in the end flap to immobilize or trap the strip.

FIG. 4 is an end view of the carton of FIG. 3, showing the second end wall and the exposed second end of the strip of material. As shown, bottom end flap 11 has a "V"-shaped notch 21 and a slit 22 in the bottom of the "V". In this embodiment, the consumer grasps the exposed second end of the strip of material and pulls it out and away from the end of the carton to lift the clip of tissues within the carton. After pulling the strip of material, which places the strip of material in tension, the consumer then pulls the strip of material downwardly through the "V"-shaped notch and into the slit. Because the strip of material is significantly wider than the slit width, the strip of material becomes folded over on itself and is held in position (immobilized) by frictional engagement with the slot. This situation is illustrated in FIG. 5.

Figure 6:
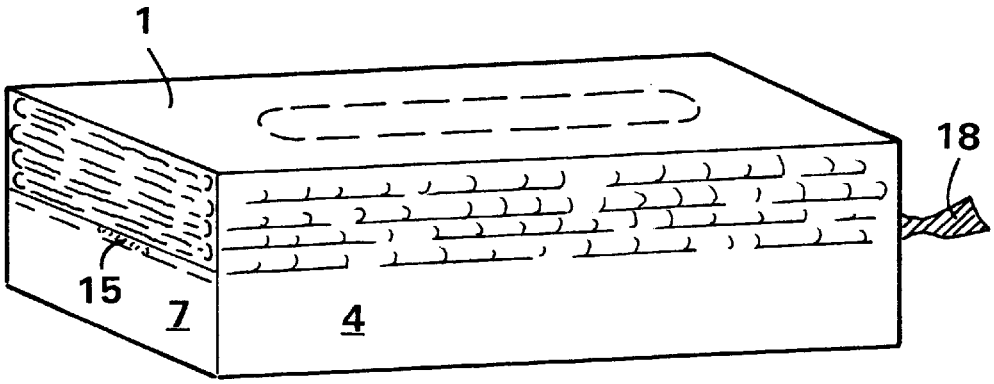
FIG. 6 is a perspective view of the carton of FIG. 5, showing how the strip of material raises the clip within the carton.

FIG. 6 shows in phantom lines the uppermost position of the lifted tissue clip after the second end of the strip of material has been pulled out as far as it can go by the user and trapped in the V-shaped slit. Depending upon the extent to which the user pulls out the end of the strip of material, the clip can be positioned anywhere between the illustrated uppermost position and the bottom of the carton.

Figure 7:
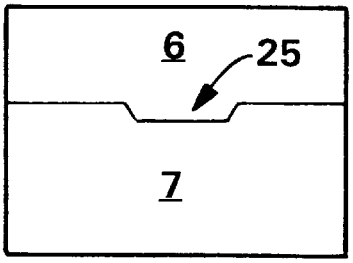
FIGS. 7 and 8 are end views of a tissue carton for an alternate embodiment of this invention.
Figure 8:
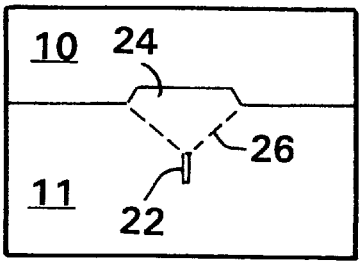

FIGS. 7 and 8 illustrate the carton end walls for an alternative embodiment of this invention which may be more preferred for aesthetic reasons as well as for ease of commercial production. FIG. 7 shows the bottom end flap for the first end wall of the carton and FIG. 8 shows the bottom end flap for the second end wall of the carton. Because of the manner in which carton blanks are cut out for mass production, the creation of tab 24 on the bottom end flap 11 of the second end wall correspondingly creates an indentation 25 in the bottom end flap 7 of the first end wall. This will be more fully described below in connection with FIG. 12. For purposes of this invention, however, the indentation 25 is not necessary. Turning attention to the tab 24 on the bottom end flap 11, this tab is perforated as shown for easy removal by the consumer. The second end of the strip of material is glued to the inside of the tab prior to filling the carton with the tissue clip. Upon removal of the tab by the consumer, a V-shaped notch is created in the bottom flap 11 such that the bottom of the "V" connects with the top of the slot 22. This creates the means to immobilize the strip of material as discussed above. Thus, when the consumer wishes to activate the clip lift feature of the carton, he/she simply grasps the tab and pulls it to tear the perforations. By continuing to pull, the clip is lifted within the carton to the desired level, and the consumer then immobilizes the strip of material by downwardly pulling the strip of material into the slot.

Figure 9:
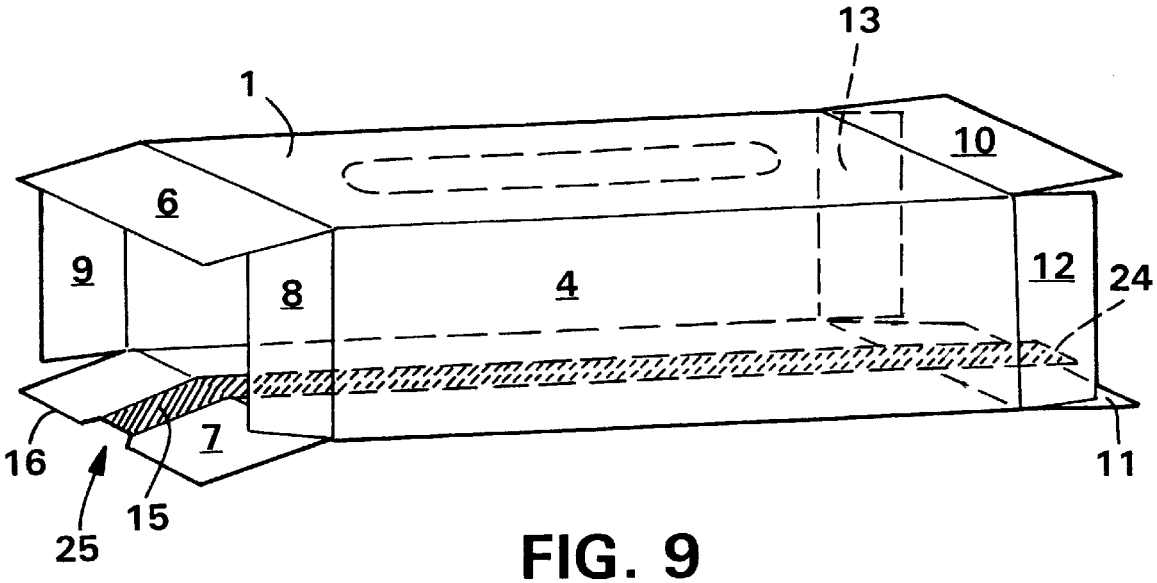
FIG. 9 is similar to FIG. 2, but further illustrating the embodiment of FIGS. 7 and 8.

FIG. 9 is a perspective view of an open carton similar to that of FIG. 2, but having the second end of the strip of material adhered to a perforated tab as shown in FIG. 8 rather than having a loose end.

Figure 10:
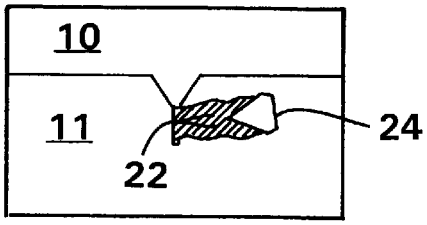
FIG. 10 is similar to FIG. 5, but further illustrating the embodiment of FIGS. 7 and 8.

FIG. 10 is similar to FIG. 5, but further illustrating the immobilization of the strip of material when using the perforated tab embodiment of FIG. 8.

Figure 11:
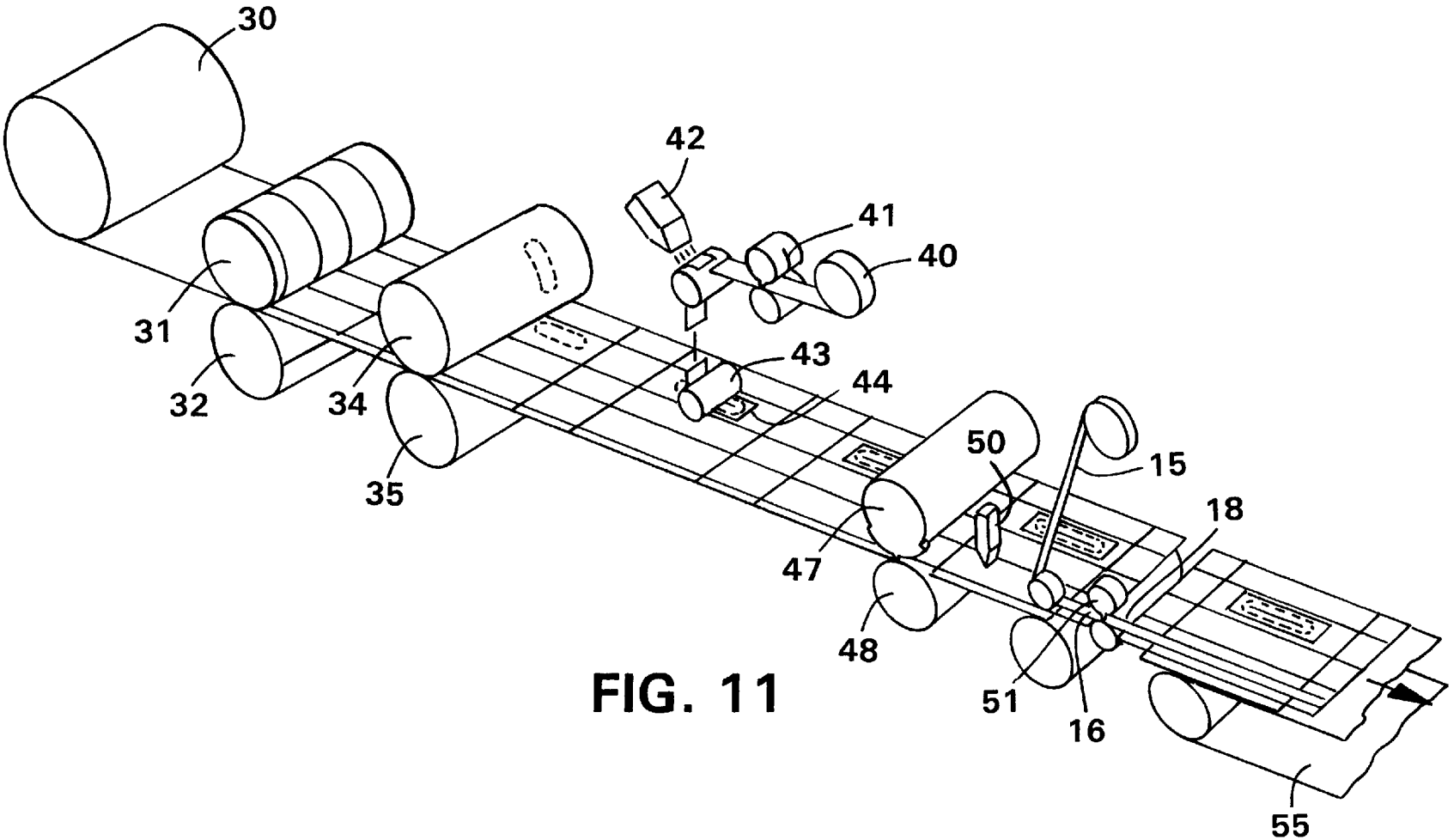
FIG. 11 is a schematic diagram of a process for making cartons in accordance with the embodiment of this invention illustrated in FIG. 2.
Figure 13:
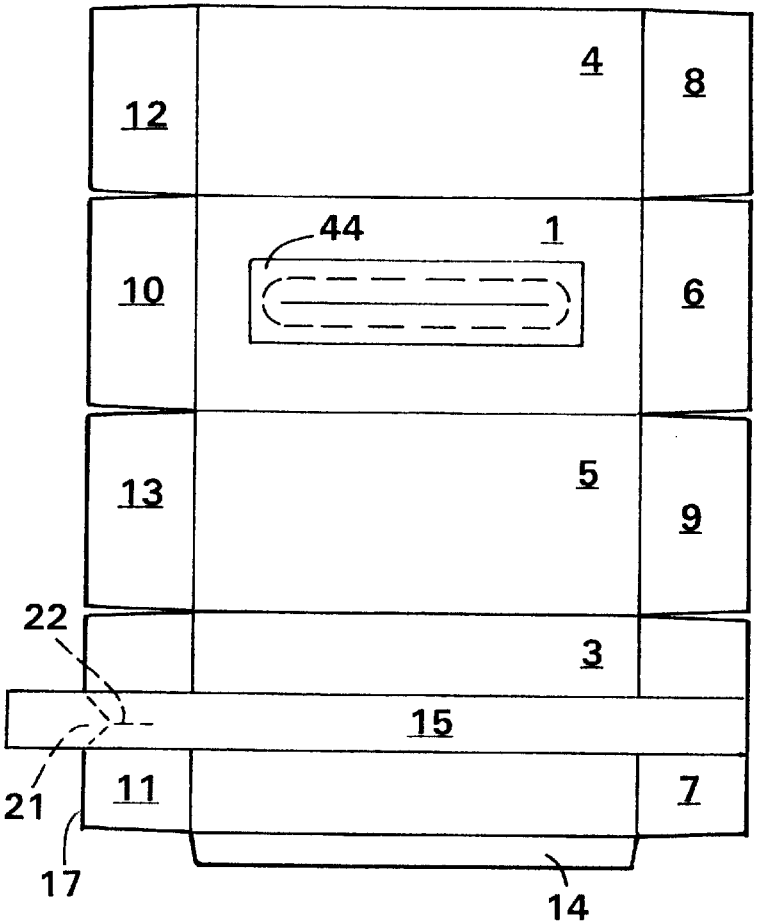
FIG. 13 is a plan view of a carton blank for the carton illustrated in FIG. 2.

FIG. 11 is a schematic diagram of a process for making carton blanks as illustrated in FIG. 13, which in turn is used for making the carton illustrated in FIG. 2. Shown is a roll of carton board 30 being unwound and optionally scored with scoring rolls 31 and 32. Scoring the carton board provides fold lines between carton panels, which makes carton assembly much easier. After scoring, a pair of perfing rolls 34 and 35 create a perforated dispensing opening within what will be the top panel of the carton.

Although not a necessary part of this invention, it is preferred to have a slit poly film attached to the inside of the carton covering the dispensing opening. As the tissues are withdrawn through the slit in the poly film, they are gently but firmly held in the pop-up position. Thus, shown is a slit poly film applicator comprising a roll of poly film 40, a slitter-cutter 41, an adhesive applicator 42, and an applicator roll 43. As shown, a rectangular piece of slit poly film 44 is adhered to the inside of the top panel covering the perforated opening 2.

The carton blank is then cut by die cutter roll 47 and anvil roll 48, thus individualizing each carton blank. Although not shown, the die cutter also cuts a notch and slit out of the appropriate portion of the carton blank which will become the means for immobilizing the strip of material when the user activates the clip lift feature of this invention. An adhesive applicator 50 intermittently applies a suitable adhesive at preselected positions to adhere the strip of material 15 in the appropriate places on the carton flaps as previously discussed. In this embodiment, the strip of material is cut (using cutter 51) at the edge 16 of what will become the bottom end flap of the first end wall of the carton. Since the carton blanks are individualized at this point of the process, the carton blank to which the strip of material has just been adhered is accelerated relative to the following carton blank to create a space between the two. This is can be achieved as shown by transferring the carton blank to a faster-moving belt 55. When the strip of material reaches the leading edge of the following carton blank, the cutter 51 again cuts the strip of material at the leading edge of the following carton blank. But since the previous carton blank has been accelerated to create a space between the two carton blanks, cutting the strip of material leaves a tail 18, which becomes the second end of the strip of material which the user will grasp to initiate the clip lift feature of this invention.

Figure 12:
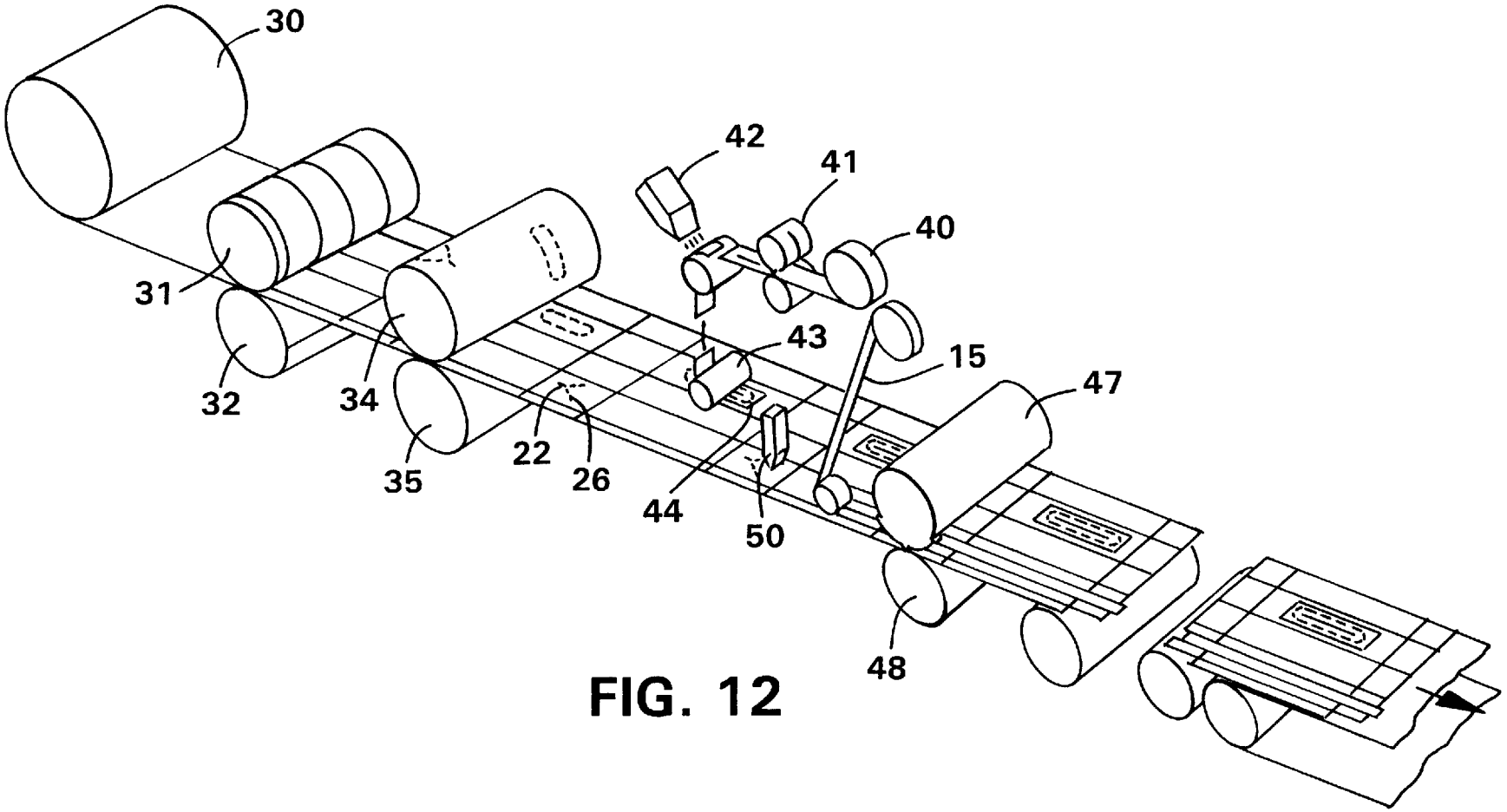
FIG. 12 is a schematic diagram of a process for making cartons in accordance with the embodiment of this invention illustrated in FIG. 9.

FIG. 12 is a schematic diagram of a carton making process for making the carton illustrated in FIG. 9. This process is similar to that of FIG. 11, but there are several differences. Perfing roll 35 also imparts V-shaped perforations 26 which are connected to a slit 22. These perforations and slit will provide the tab 24 as previously described. After the poly window is applied to the carton blank as previously described, adhesive is intermittently applied with adhesive applicator 50. The strip of material 15 is continuously applied prior to the individual carton blanks being die cut using die cutter roll 47 and anvil roll 48. Die cutting the carton blanks to individualize them also simultaneously cuts the strip of material at both ends of the carton blank.

FIG. 13 is a flat carton blank for the carton of FIG. 2 produced by the process illustrated in FIG. 11. Shown is a carton blank comprising: a top panel 1, a bottom panel 3, a first side wall panel 4, a second side wall panel 5, and a glue panel 14, a first top flap panel 6 adjacent to a first end of the top panel, a second top flap panel 10 adjacent to a second end of the top panel, a first bottom flap panel 7 adjacent to a first end of the bottom panel, a second bottom flap panel 11 adjacent to a second end of the bottom panel, a first side flap panel 8 adjacent a first end of the first side wall panel, a second side flap panel 12 adjacent a second end of the first side wall panel, a first side flap panel 9 adjacent a first end of the second side wall panel, and a second side flap panel 13 adjacent a second end of the second side wall panel. A strip of material 15 having a first end and a second end overlays the entire length of the bottom panel, the first end of the strip being adhered to the first bottom flap panel 7 and the second end of the strip extending beyond the distal edge 17 of the second bottom flap panel 11. The second bottom flap panel contains a slit 22 adapted to receive the second end of the strip of material after the carton is assembled. The distal edge of the second bottom flap panel has a notch 21, with the slit emanating from the bottom of the notch as shown.

Figure 14:
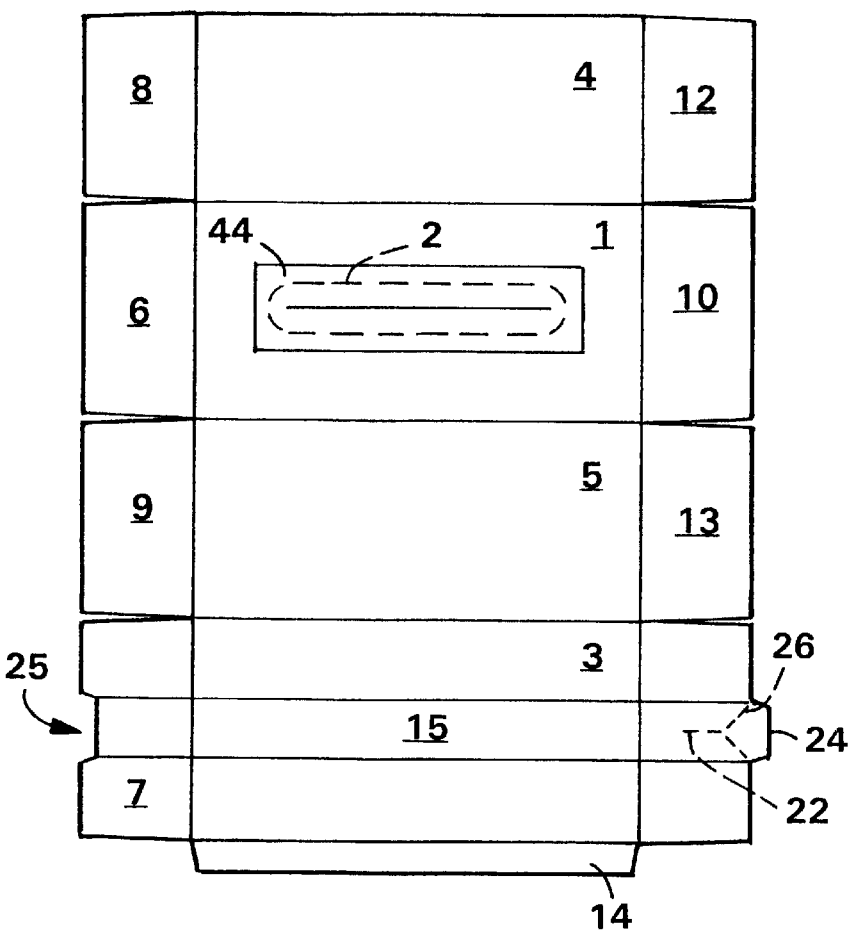
FIG. 14 is a plan view of a carton blank for the carton illustrated in FIG. 9.

FIG. 14 is a flat carton blank for the carton of FIG. 9 produced by the process of FIG. 12. Shown is a carton blank comprising: a top panel 1, a bottom panel 3, a first side wall panel 4, a second side wall panel 5, and a glue panel 14, a first top flap panel 6 adjacent to a first end of the top panel, a second top flap panel 10 adjacent to a second end of the top panel, a first bottom flap panel 7 adjacent to a first end of the bottom panel, a second bottom flap panel 11 adjacent to a second end of the bottom panel, a first side flap panel 8 adjacent a first end of the first side wall panel, a second side flap panel 12 adjacent a second end of the first side wall panel, a first side flap panel 9 adjacent a first end of the second side wall panel, and a second side flap panel 13 adjacent a second end of the second side wall panel. A strip of material 15 having a first end and a second end overlays the entire length of the bottom panel, the first end of the strip being adhered to the first bottom flap panel 7 and the second end of the strip extending to the distal edge 17 of the second bottom flap panel 11. The second bottom flap panel contains a slit 22 adapted to receive the second end of the strip of material after the carton is assembled. The distal edge of the second bottom flap panel has a tab 24 and a perforated notch 26 with the slit emanating from the bottom of the perforated notch. In this embodiment, the second end of the strip of material is substantially adhered or fixed to the perforated notch portion of the second bottom flap panel.

It will be appreciated that the foregoing description, given for purposes of illustration, is not to be construed as limiting the scope of this invention, which is defined by the following claims and all equivalents thereto.

I claim:

1. A method of making a carton blank comprising: (a) die cutting a sheet of carton board in the form of a carton blank having a top panel, a bottom panel, a first side wall panel, a second side wall panel, a glue panel, a first top flap panel adjacent to a first end of the top panel, a second top panel adjacent to a second end of the top panel, a first bottom flap panel adjacent to a first end of the bottom panel, a second bottom flap panel adjacent to a second end of the bottom panel, a first side flap panel adjacent a first end of the first side wall panel, a second side flap panel adjacent a second end of the first side wall panel, a first side flap panel adjacent a first end of the second side wall panel, and a second side flap panel adjacent a second end of the second side wall panel; (b) providing a slit in the second bottom flap panel that emanates from the distal edge of the second bottom flap panel; (c) laying a first end of a strip of material over the bottom panel such that the strip of material extends from the first bottom flap panel to beyond the distal edge of the second bottom flap panel; (d) adhering the first end of the strip of material to the first bottom flap panel; and (e) cutting the strip of material at a point beyond the distal edge of the second bottom flap panel.

2. A method of making a carton blank comprising: (a) periodically cutting a strip of carton board to form a slit and perforations such that the perforations define an area within the carton board which will become a perforated tab; (b) adhering a strip of material to the carton board at points corresponding to the areas defined by the perforations and at points which correspond to areas which will become a first bottom flap; and (c) simultaneously cutting the adhered strip of material and consecutively die cutting adjacent carton blanks from the carton board which have a top panel, a bottom panel, a first side wall panel, a second side wall panel, a glue panel, a first top flap panel adjacent to a first end of the top panel, a second top flap panel adjacent to a second end of the top panel, a first bottom flap panel adjacent to a first end of the bottom panel, a second bottom flap panel adjacent to a second end of the bottom panel, a first side flap panel adjacent a first end of the first side wall panel, a second side flap panel adjacent a second end of the first side wall panel, a first side flap panel adjacent a first end of the second side wall panel, and a second side flap panel adjacent a second end of the second side wall panel.

* * * * *